United States Patent [19]

Morewood

[11] 4,277,213

[45] Jul. 7, 1981

[54] SELF-FEEDING DEVICE FOR HANDICAPPED PERSONS

[75] Inventor: William H. Morewood, Pennington, N.J.

[73] Assignee: Winsford Products, Inc., Pennington, N.J.

[21] Appl. No.: 58,724

[22] Filed: Jul. 18, 1979

[51] Int. Cl.[3] ..... A47G 21/08

[52] U.S. Cl. ..... 414/9; 414/4; 414/744 R; 414/706; 414/777

[58] Field of Search ..... 414/9, 4, 777, 706, 414/757, 744 R, 707, 710; 198/517, 518, 520, 510, 514, 515; 128/222, 223; 222/361, 362

[56] References Cited

U.S. PATENT DOCUMENTS

| | | | |
|---|---|---|---|
| 1,333,209 | 3/1920 | Maguire | 414/9 |
| 1,819,515 | 8/1931 | Jenkins | 198/517 X |
| 2,686,408 | 8/1954 | Walker | 414/9 |
| 2,696,288 | 12/1954 | Ball | 198/515 |
| 3,088,613 | 5/1963 | Wuesthoff | 414/757 X |
| 3,317,061 | 5/1967 | Causey | 414/9 |
| 3,734,306 | 5/1973 | Morewood | 414/9 |
| 3,885,681 | 5/1975 | Mancino | 414/9 |
| 3,907,126 | 9/1975 | Sydnor, Sr. | 414/9 |
| 3,993,199 | 11/1976 | Jorgensen et al. | 414/757 |
| 4,187,049 | 2/1980 | Jones | 414/725 X |

*Primary Examiner*—Frank E. Werner
*Attorney, Agent, or Firm*—Ostrolenk, Faber, Gerb & Soffen

[57] ABSTRACT

A self-feeding device for automatically lifting food from the eating surface of a plate to an eating position located above the plate. The plate is supported by a plurality of rollers which are capable of rotating the plate about a predetermined axis. A pusher arm having a food pushing surface depending therefrom is rotatable about a second axis, parallel to and spaced from the first axis, such that the food pushing surface moves from a first to a second position along a predetermined path which traverses a portion of the eating surface of the plate in such a manner that food located on the eating surface of the plate along the predetermined path is moved by the pushing surface. A spoon support and lifting arm supports the spoon and is capable of moving the spoon between a lower position in which food moved by the food pushing surface is moved onto the spoon and an upper position in which food moved on the spoon by the pushing surface is located at the eating position. A control circuit is provided which enables the individual utilizing the self-feeding device to control the operation of the plate support rollers, the pusher arm, and the spoon support and lifting arm.

21 Claims, 18 Drawing Figures

PLATE ROTATION MOTOR
PUSHER MOTOR
LIFT MOTOR

SELF-FEEDING DEVICE FOR HANDICAPPED PERSONS

BACKGROUND OF THE INVENTION

The present invention is directed towards a self-feeding device for handicapped persons, and more particularly to a self-feeding device for a person who can move his head but not necessarily his arms and feet.

A self-feeding device of the foregoing type is described in U.S. Pat. No. 3,734,306 issued to the inventor of the present invention. While the foregoing device represents a major improvement over the self-feeding devices of the prior art, it has several drawbacks.

In the self-feeder of the foregoing patent, a spoon holding and lifting mechanism automatically moves a spoon between a lower position located adjacent a plate containing a meal to be eaten and an upper position located adjacent the mouth of the operator (the handicapped person) of the self-feeding device. The primary drawback of this self feeder is that food is pushed onto the spoon by the handicapped person using a specially designed pusher which is attached to his head. Since the pusher is operated manually, the operator has to have a reasonably high degree of control over his neck muscles to properly coordinate the pushing of a desired amount of food from any given portion of the plate onto the spoon. In addition to pushing food onto the spoon, the pusher is used to close a switch located on the frame of the self-feeding device thereby initiating a spoon raising or spoon lowering operation. This operation required yet additional coordination on the part of the operator of the device.

In addition to requiring a relatively high degree of coordination, the self-feeding device of the foregoing patent necessitated the use of a somewhat awkward looking head set. In addition to being unattractive, the head set was somewhat uncomfortable and it was generally found objectionable by many of the potential operators of the self-feeding device.

BRIEF DESCRIPTION OF THE INVENTION

In order to overcome the foregoing drawbacks of the above-noted patent, the present invention replaces the headset and pusher with a mechanical pusher which automatically transfers food from the plate onto the spoon. The operation of the pusher is preferably controlled by means of a chin switch which requires minimal coordination on the part of the operator. In addition to utilizing an automatic pushing mechanism, the present invention provides means for rotating the plate so as to enable the operator to place new portions of the plate, and therefore new pieces of food, into the path of the pusher. This operation is also controlled by operation of the chin switch. As a result, a minimum amount of coordination on the part of the operator is required to provide the operator with complete control over the operation of the feeding mechanism. Additionally, since the head gear of the prior art is no longer required, the self-feeder of the present invention provides a handicapped person with a greater degree of dignity than has previously been possible.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

DETAILED DESCRIPTION OF THE PREFERRED EMBODIMENT

Figure 1:
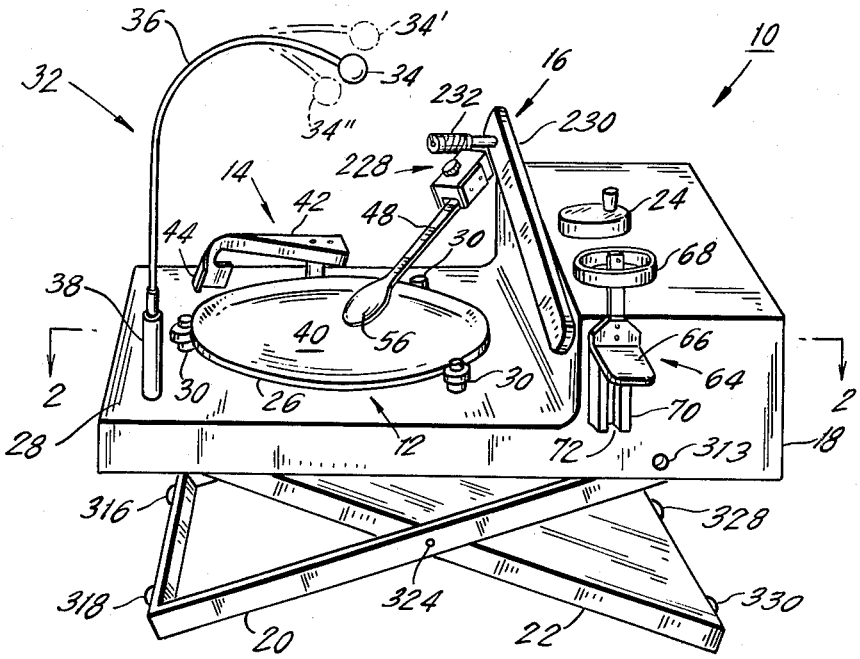
FIG. 1 is a perspective view of the self-feeding device of the present invention.

Referring now to the drawings, wherein like numerals indicate like elements, there is shown in FIG. 1 a self-feeding device constructed in accordance with the principles of the present invention and designated generally as 10. The primary components of self-feeding device 10 are a plate support and rotating section 12, a food pusher section 14 and a spoon support and lifting section 16. The operation of each of these sections will first be described in a general manner so as to enable those skilled in the art to understand how these sections cooperate to perform the self-feeding function of the present invention. The detailed structure of each of these sections is described in detail below under appropriate subheadings.

The plate support and rotating section 12 includes a housing 18 supported above a planar surface by a pair of adjustable legs 20, 22. The height of the housing 18 with respect to the planar support surface is adjusted by rotating crank 24 in either a clockwise or counterclockwise direction. For reasons which will become apparent below, the height of housing 18 with respect to the planar support surface is adjusted each time a user of the self-feeding device 10 begins a meal and is retained at that position throughout the meal.

The plate 26 is supported above the planar surface 28 of housing 18 by a plurality (preferably 3) of vertical shaft rollers 30. See FIGS. 1 and 2. Rollers 30 support plate 26 about a predetermined axis and rotate plate 26 about that axis responsive to the selective actuation of a chin switch 32. Chin switch 32 includes a spherical contact portion 34 which is located at the distal end of an elastic neck portion 36, the remaining end of which is rotatably coupled to housing 18 by a support mechanism 38. Chin switch 32 is normally biased into the off or rest position shown in solid lines in FIG. 1 and is rotatable about the axis defined by support member 38 in both a clockwise and counterclockwise direction. When spherical contact portion 34 is rotated counterclockwise to the phantom position 34', vertical shaft rollers 30 are rotated to cause an angular rotation of plate 26. As long as spherical contact portion 34 is held in the phantom position 34', rollers 30 will continue rotating plate 26. In this manner, different pieces of food located on the eating surface 40 of plate 26 may be moved into the path traversed by pusher arm 42 as it moves across plate 26.

Figure 2:
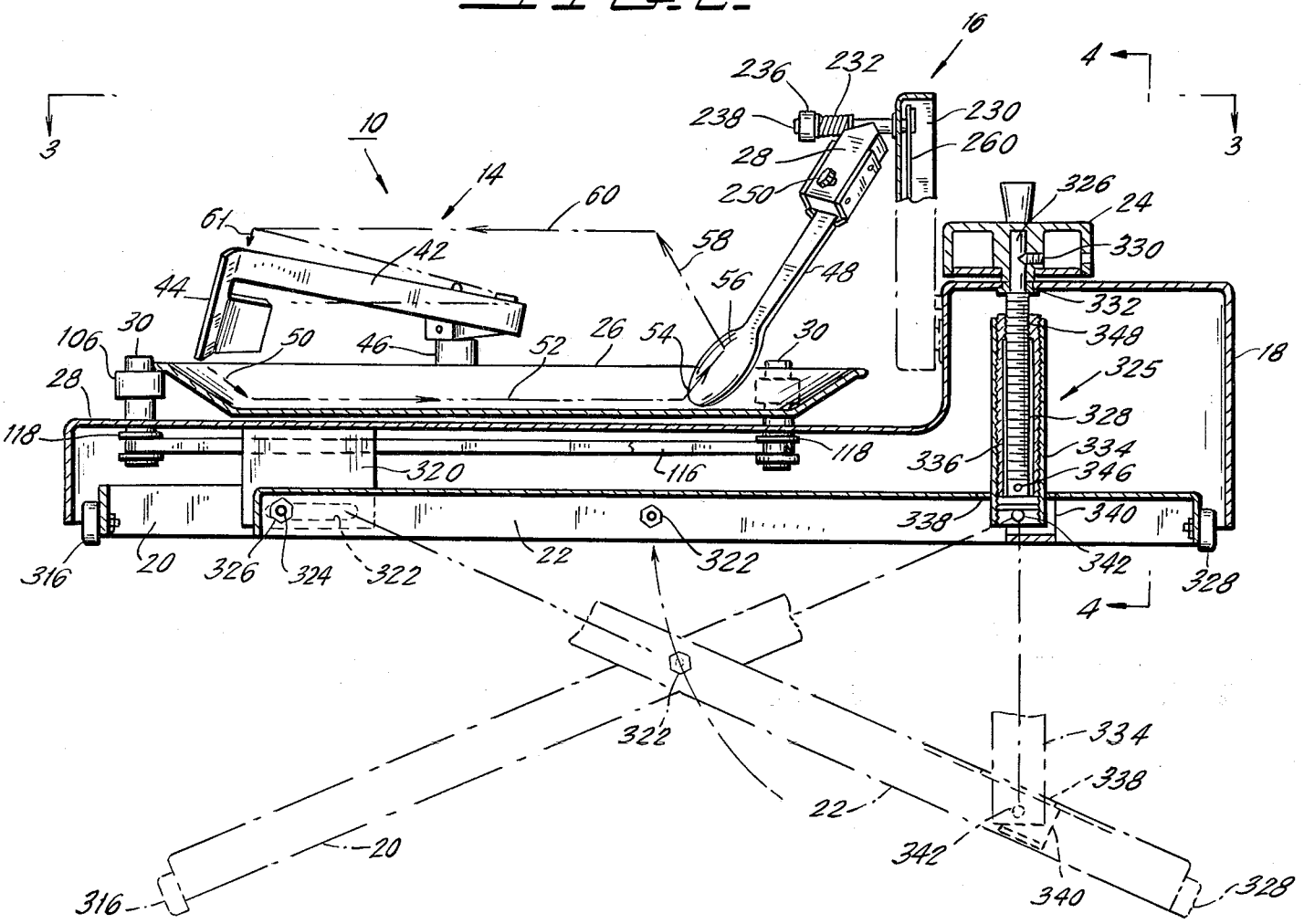
FIG. 2 is a cross-sectional view of the present invention taken along lines 2—2 of FIG. 1.
Figure 3:
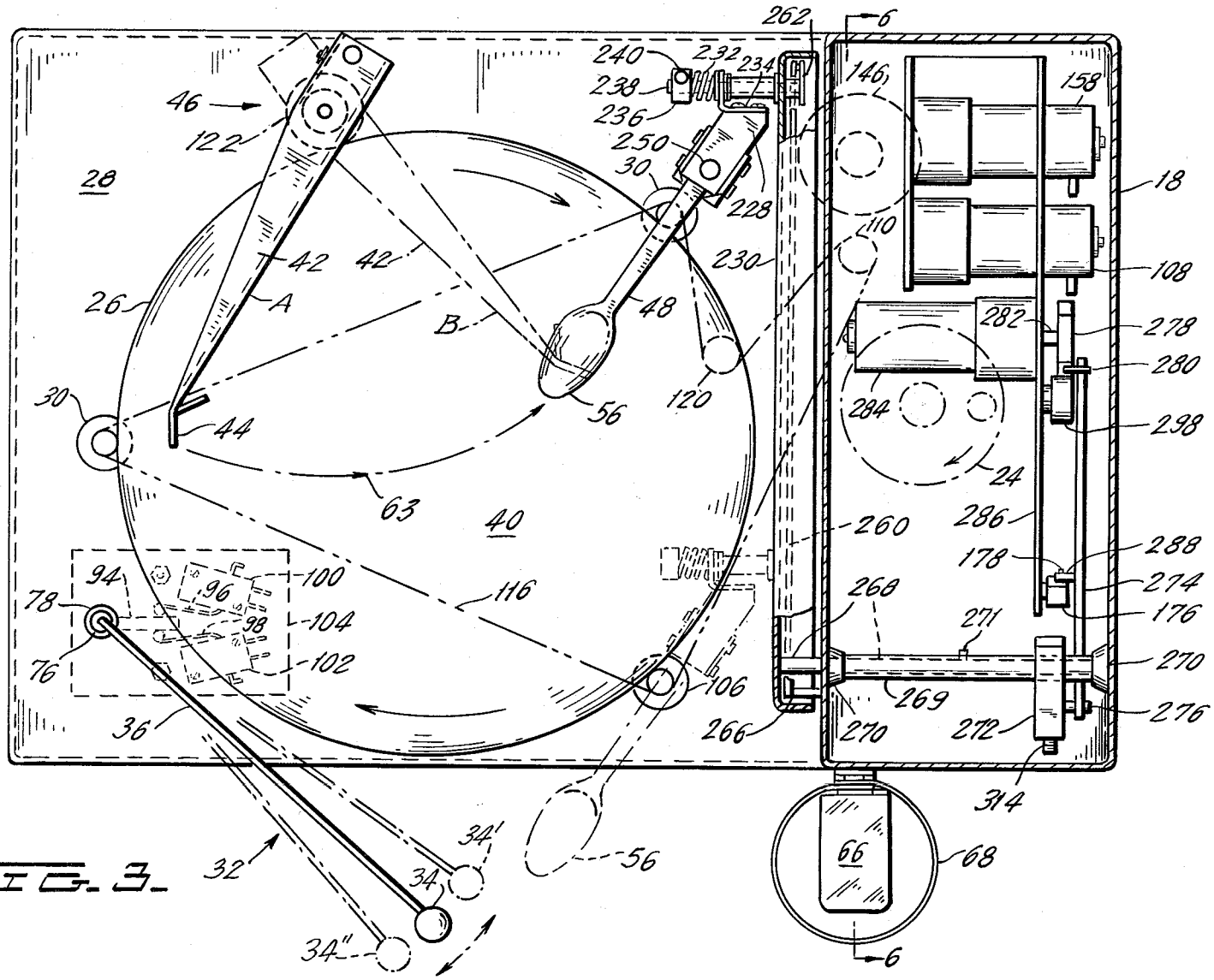
FIG. 3 is a top view of the present invention illustrating the position of several of the elements of the invention during different stages of operation thereof.

The manner in which pusher arm 42 moves over plate 26 may best be understood with reference to FIGS. 2 and 3. As shown therein, a food pushing surface 44 depends from the distal end of pusher arm 42, the remaining end of which is rotatably supported by support member 46. Food pushing surface 44 preferably has an angled face which will better contain food located on eating surface 40 as food pushing surface 44 moves from a first position A (shown in solid lines in FIG. 3) located adjacent the periphery of plate 26 to a second position B (shown in phantom in FIG. 3) located adjacent spoon 48.

Movement of pusher arm 42 is initiated by rotating spherical contact portion 34 clockwise into the phantom position 34". When chin switch 32 has been moved into this position, pusher arm 42 moves from its first position to its second position along a path defined by path segments 50, 52, 54. See FIG. 2. Path segments 50, 52 conform to the contour of eating surface 40 of plate 26 while path 54 follows generally the rim portion 53 of bowl 56 of spoon 48. Thereafter, pusher arm 42 returns to its first position via a second path defined by path segments 58, 60 and 61 which are above eating surface 40 of plate 26 and therefore will not contact any food located on plate 26. As a result of this motion, food located on the eating surface 40 of plate 26 along the arcuate path 63 traversed by food pushing surface 44 (see FIG. 3) will be moved onto the bowl portion 56 of spoon 48 when pusher arm 42 moves from its first position A to its second position B and will not be pushed off plate 26 when pusher arm 42 moves from its second to its first position.

After pusher arm 42 has moved away from its second position and is about halfway back to its first position (along path 60), spoon 48 is lifted from its lower position (illustrated in FIG. 2) to its upper position (illustrated in phantom in FIG. 4) by the lift arm 230 of spoon support and lifting section 16. Once spoon 48 is raised into its upper position, it is retained in this position until the spherical contact portion 34 of chain switch 32 is again rotated clockwise into its phantom position 34" by the operator 62 (FIG. 4) of the feeder 10. At the beginning of a meal, the height of housing 18 (and therefore the height of spoon 48) is adjusted by rotating crank arm 24 in either the clockwise or counterclockwise direction to ensure that spoon 48 will be at a height at which the operator 62 can easily place his mouth around the bowl portion 56 of spoon 48 when the spoon 48 is in its upper position. This position will be referred to herein as the eating position. In addition to adjusting the level of spoon 48, this adjustment also adjusts the height of spherical contact position 34 of chin switch 32 so that it is conveniently located and easily contacted by the chin of operator 62.

After the operator 62 has removed food from spoon 48, he can return the spoon to its lower position by again rotating spherical contact portion 34 in the clockwise direction into phantom position 34". Once in this position, chin switch 32 causes spoon support and lifting section 16 to return spoon 48 to its lower position adjacent the food eating surface 40 of plate 26 as illustrated in FIGS. 1 and 2. At this point, operator 62 may expose new food to pusher arm 42 by causing plate 26 to rotate (by rotating chin switch 32 counterclockwise) and thereafter causing pusher arm 42 to push food onto spoon 48 (by rotating chin switch 32 clockwise).

While the present invention is concerned primarily with the automatic feeding of solid and semisolid foods off a plate, provision may also be made to feed liquids. This function is provided by a glass support 64 (see FIG. 1) which includes a base portion 66 supporting the bottom of the glass (not shown) and a ring portion 68 supporting the side of the glass. Base portion 66 is preferably slidably attached to a support member 70 having a groove 72 formed therein. The groove 72 receives a corresponding flange (not shown) coupled to base portion 66 and enables the height of base portion 66 with respect to housing 18 to be adjusted. The flange coupled to base portion 66 may be made to fit sufficiently snugly into groove 72 to provide sufficient friction support for the weight of the glass and the liquid therein. If a straw of suitable length is placed in the glass held by glass support 64, the operator 62 may freely drink liquid contained in the glass.

Having reviewed the general operation of each of the primary sections of the present invention, the structure of these subsections will now be described in detail.

CONTROL SWITCH

The manner in which control switch 32 controls the operation of self-feeding device 10 has already been described above. As shown in FIG. 1, control switch 32 includes a spherical contact portion 34 connected to the distal end of a resilient neck portion 36, the remaining end of which is rotatably coupled to housing 18 by support member 38.

Figure 5:
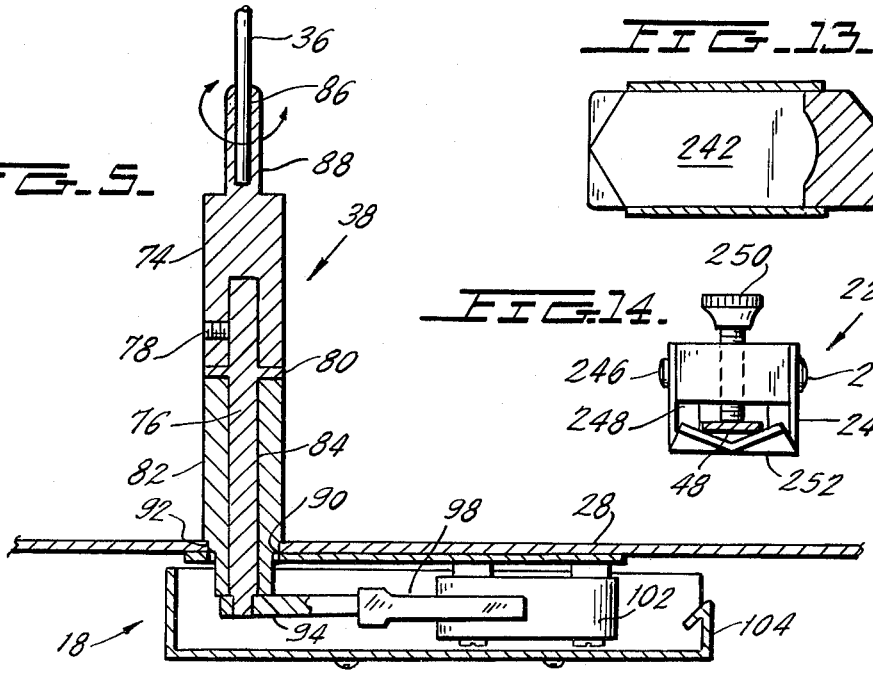
FIG. 5 is a detailed view, partially in cross-section, of a portion of the chin switch of the present invention.

As best viewed in FIG. 5, support member 38 includes a cylindrical sleeve member 74 which is coupled to a cylindrical rod 76 by a set screw 78. Cylindrical rod 76 includes a flange member 80 which sits on top of a second cylindrical member 82 in such a manner that cylindrical rod 76, and with it sleeve member 74, may be rotated about the axis defined by the central opening 84 in cylindrical sleeve member 82. A step 90 is formed in the lower portion of sleeve member 82 and fits within a circular opening 92 formed in the planar surface 28 of housing 18. Cyindrical sleeve member 82 is fixedly attached to housing 18 by any appropriate means.

The base portion of elastic neck 36 is retained in a cylindrical recess 86 formed in extension section 88 of sleeve member 74. As such, whenever spherical contact portion 34 of chin switch 32 is rotated either clockwise or counterclockwise, cylindrical sleeve member 78, and therefore cylindrical rod 76, is rotated therewith.

The lower end of cylindrical rod 76 extends through the bottom of cylindrical sleeve member 82 into the interior of housing 18. As best seen in FIGS. 3 and 5, a contact tongue 94 is attached to the bottom of cylindrical rod 76 for rotation therewith. The distal end of tongue 94 is in contact with switch arms 96, 98 of switches 100, 102, respectively. When spherical contact portion 34 of chin switch 32 is in its rest position (the position shown in solid lines in FIG. 3), tongue 94 is in the position shown and switch arms 96, 98 will be in the positions illustrated in FIG. 12. When spherical contact portion 34 is rotated counterclockwise into position 34', tongue 94 is rotated counterclockwise, causing switch arm 96 of switch 100 to close and thereby supplying power to plate rotation motor 108. In a manner which is described below, the application of power to plate rotation motor 108 causes the rotation of rollers 30 and therefore the rotation of plate 26. When spherical contact portion 34 is rotated clockwise into position 34'', tongue 94 also rotates clockwise closing switch arm 98 to contact contact terminal 174. If spoon 48 is in its lower position, switch arm 178 of switch 176 will be in the position shown and power will be applied to pusher motor 158 causing pusher arm 42 to complete one back and forth motion between its first and second positions A and B. If spoon 48 is in its upper position, switch arm 178 of switch 176 will contact contact terminal 179 and lift motor 284 will be energized. As will be shown below, this energization of lift motor 284 causes lift arm 230 to return from its upper to its lower position, thereby returning spoon 48 to its lower position adjacent plate 26.

In order to ensure that switches 100, 102 are not damaged by loose objects located in housing 18, switches 100 and 102 are enclosed in a protective housing 104.

In the preferred embodiment, a chin switch 32 is employed. It should be recognized, however, that any other type of switch, such as a hand switch, may be utilized. The only requirement of the control switch is that it be adapted for use by the individual utilizing the self-feeding device 10.

PLATE SUPPORT AND ROTATING SECTION

As best viewed in FIGS. 2 and 3, the bottom edge of plate 26 rides on the step portion 106 of each of the vertical shaft rollers 30 and may be easily removed therefrom for cleaning and refilling. Rollers 30 are preferably formed of a friction material which insures good friction contact between the bottom edge of plate 26 and the rollers in order that the plate 26 will rotate in response to the rotation of rollers 30. Rotary motion is imparted to each of the rollers 30 by a plate rotation motor 108 which is enabled whenever switch 100 is closed by the counterclockwise rotation of chin switch 34. When enabled, motor 108 rotates its output shaft 109 which is coupled to a power drive pulley 110 by a pair of bevel gears 112, 114. See FIGS. 6 and 15. As best seen in FIGS. 2 and 3, power drive pulley 110 is coupled to each of the vertical shaft rollers 30 by a flexible belt 116 which is received in the belt receiving portions 118 of rollers 30 and pulley 110. An idler pulley 120 also receives belt 116 and insures that belt 116 remains sufficiently taut to provide good friction contact between belt 116 and belt receiving portions 118. As a result, the rotary motion imparted to power drive pulley 110 by motor 108 will cause the rotation of vertical shaft rollers 30, and therefore the rotation of plate 26 as long as motor 108 is enabled by the counterclockwise rotation of chin switch 32.

FOOD PUSHER SECTION

Figures 8, 9, 10, 11, 16:
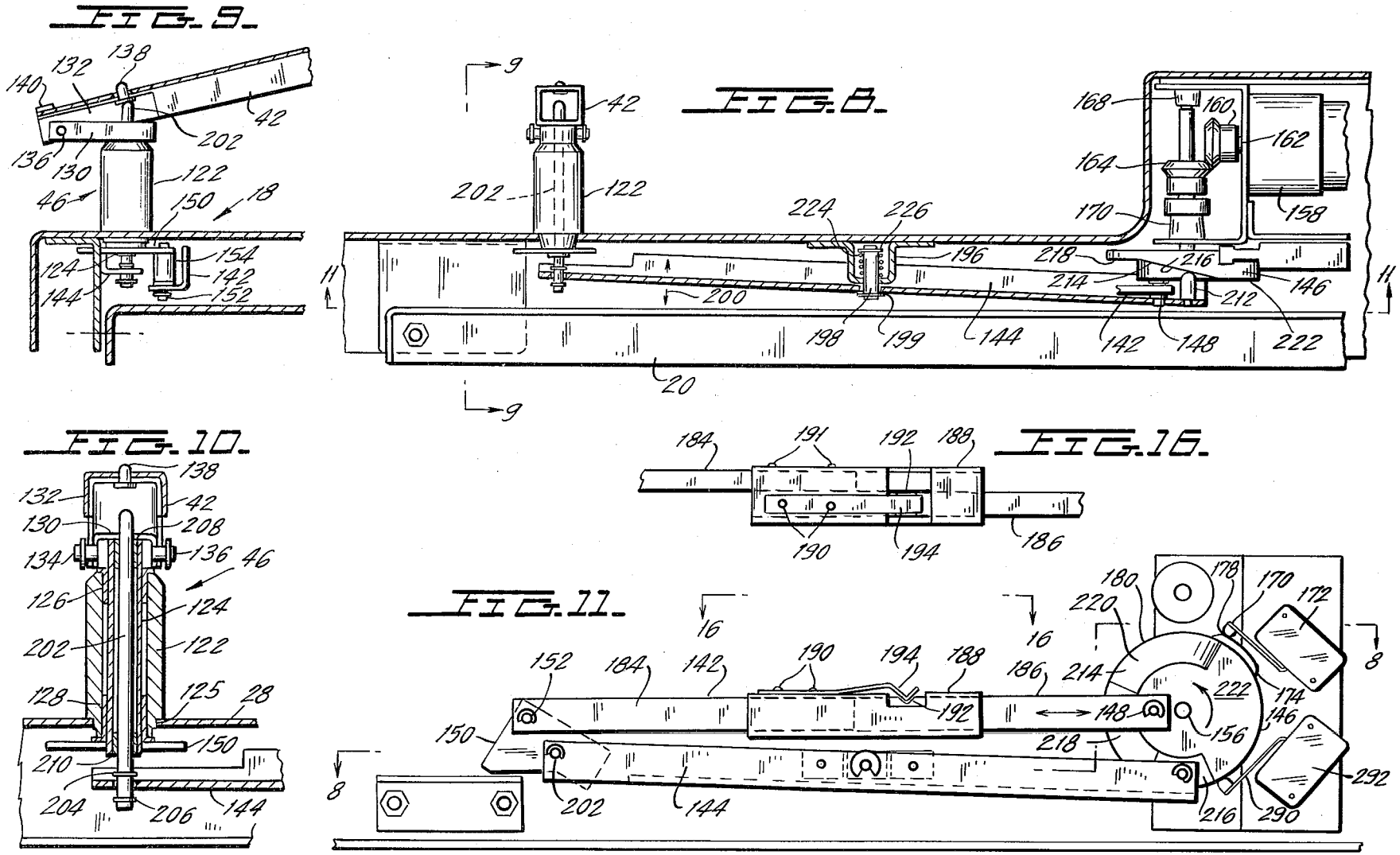
FIG. 8 is a cross-sectional view illustrating a portion of the food pushing mechanism of the present invention taken along lines 8—8 of FIG. 11.
FIG. 9 is a cross-sectional view of a portion of the pusher mechanism of the present invention taken along lines 9—9 of FIG. 8.
FIG. 10 is a detailed cross-sectional view of a support member forming a portion of the food pusher mechanism illustrated in FIG. 8.
FIG. 11 is a bottom view of a portion of the food pusher mechanism of the present invention taken along lines 11—11 of FIG. 8.
FIG. 16 is a detailed side view of a control arm forming part of the food pusher mechanism of the present invention.

As noted above, pusher arm 42 is rotatably coupled to housing 18 by a support member 46. As best seen in FIGS. 8–10, support member 46 includes a cylindrical support member 122 which extends through a circular opening 125 formed in the planar surface 28 of housing 18 and is secured thereto by appropriate means. A cylindrical insert 124 is rotatably supported within support member 122 by a pair of low friction cylindrical sleeves 126, 128 located on either end of support member 122. The upper end of sleeve 124 is fixedly coupled to member 130 which rotates with insert 124 about the central axis of cylindrical support member 122. The distal end of U-shaped member 132 (see FIG. 9) is pivotally coupled to a base support member 130 by a pair of pivot pins 134, 136. Pusher arm 42 is coupled to U-shaped member 132 by a pair of connecting pins 138, 140 which are fastened to member 132. Pusher arm 42 contains a hole for pin 138 and an open end slot for pin 140. It may, therefore, be readily lifted off U-shaped member 130 for cleaning.

As a result of the foregoing structure, pusher arm 42 may be rotated about a first axis defined by the central axis of cylindrical support member 122 and about a second axis defined by the central axis of pivot pins 134, 136. When pushing surface 44 of pusher arm 42 moves from its first position A towards its second position B along path segments 50, 52 (see FIG. 2), pusher arm 42 must be free to drop against the food eating surface 40 of plate 26 so as to follow the contour of that surface. Simultaneously, pusher arm 42 must be rotated about the central axis of support member 122 (see FIG. 3). When traversing the path segment 54, pusher arm 42 must be rotated in an upward direction around the axis defined by pivot pins 134, 136 and must be further rotated from left to right as viewed in FIG. 2 about the axis of support member 122. When food pushing surface 44 traverses path segment 58, pusher arm 42 must be raised about the axis defined by pivot pins 134, 136 and must be rotated from right to left as viewed in FIG. 2 about the axis defined by support member 122. As food pushing surface 44 is moved along path segment 60, pusher arm 42 must be retained in its uppermost position and rotated from right to left as viewed in FIG. 2 about the axis of support member 122. Finally, as pusher surface 44 moves along path segment 61, it must be rotated downwardly about the axis defined by pivot pins 134, 136 and from left to right as viewed in FIG. 2 about the axis defined by cylindrical support member 122.

As made clear from the foregoing description, the motion of pusher arm 42 (and therefore food pushing surface 44) has two components; a first component defined by the angular orientation of arm 42 about the axis of support member 122 and a second component defined by the angular orientation of arm 42 about the axis defined by pivot pins 134, 136. These two components of movement are controlled by the operation of control arms 142, 144, respectively. The operation of these arms is controlled, in turn, by rotating member 146.

The manner in which control arm 142 controls the rotation of pusher arm 42 about the axis of cylindrical support member 122 will be described with reference to FIGS. 9–11. As shown in FIG. 11, control arm 142 is rotatably coupled at one end to rotating member 146 by a pivot pin 148 and at the other end to a crank 150 by a crank pin 152. As best seen in FIG. 9, control arm 142 is L-shaped and is spaced from crank 150 by a spacer member 154. Crank 150 is coupled to the bottom of cylindrical insert 124 for rotation therewith about the axis of cylindrical support member 122. As a result, crank 150 (and therefore pusher arm 42) will reciprocate about the axis of cylindrical support member 122 as rotating member 146 is rotated about its axis 156.

The rotation of rotating member 146 about axis 156 is controlled by the operation of pusher motor 158. When power is applied to motor 158, it rotates a bevel gear 160 connected to its output shaft 162 which in turn causes the rotation of bevel gear 164. Bevel gear 164 is coupled to shaft 166 which is supported between bearings 168, 170 and which is coupled at its distal end to the central axis of rotating member 146. As such, whenever power is applied to pusher motor 158, rotating member 146 rotates in a counterclockwise direction as viewed in FIG. 11.

As viewed in FIG. 11, rotating member 146 is in a position corresponding to the first position A of pusher arm 42 (see FIG. 3) and the feeder is at rest. In this position, switch arm 170 of switch 172 rides on cam 174 of rotating member 146 and places switch 172 in the open position. When switch 102 (FIG. 3) is closed by the clockwise movement of spherical contact portion 34 into position 34', switch arm 98 of switch 102 (see FIG. 12) moves into contact with contact terminal 174 causing power to be applied to pusher motor 158 via switch 176. Switch 176 forms part of the spoon support section 16 and will be described in further detail below. It is sufficient at this point to note that the contact arm 178 of switch 176 will be in the position shown in FIG. 12 whenever spoon 48 is in the lower position illustrated in FIG. 1. The power applied to pusher motor 158 causes rotating member 146 to rotate in a counterclockwise direction, thereby causing crank 150 to begin rotating clockwise about the axis of support member 122 as viewed in FIG. 11. This clockwise motion causes pusher arm 42 to rotate counterclockwise towards spoon 48 as viewed in FIG. 3. Shortly after pusher 42 leaves its first position A, the cam follower portion 178 of switch arm 170 disengages the cam 174 on rotating member 146 and comes into contact with the outer circumference 180 of member 146. In this condition, switch 172 closes, causing power to flow through line 182 (see FIG. 12) to pusher motor 158. Power will continue to be applied to motor 158 and rotating member 146 will continue to rotate until cam 174 returns to the position illustrated in FIG. 11 and opens switch 172. Responsive to the rotation of rotating member 146, crank 150, and therefore pusher arm 42, reciprocate back and forth about the axis of support member 122. As a result, pusher arm 42 moves from its first position A to its second position B and back to its first position A each time switch 102 is closed by the operator 62 of the automatic feeding device 10.

As a safety feature, control arm 142 is preferably formed of two separate members 184, 186 which are coupled to each other by a sleeve member 188. Sleeve member 188 surrounds both members 184, 186 and situates these members in an overlapping position with their opposing major faces overlapping. See FIGS. 11 and 16. Sleeve member 188 is secured to member 184 by screws 190 and is freely slidable with respect to member 186. A V-shaped notch 192 is formed in the upper surface of member 186 and receives a corresponding V-shaped projection on a leaf spring 194. Leaf spring 194 is fixedly attached to sleeve member 188 by screws 191. The resilience of leaf spring 194 is sufficiently great to insure that the V-shaped projection on leaf spring 194 is retained in notch 192 during the normal operation of pusher arm 42 (i.e., when pusher arm 42 only contacts food which is pushed onto spoon 48). The resiliency of leaf spring 194 also permits its V-shaped portion to disengage V-shaped notch 192, and thereby permit member 186 to slide relative to member 188, whenever an unusually high force which might otherwise damage feeder 10 is applied to pusher arm 42. Such a situation may occur when food has dried on the plate 26 or when a heavy object has fallen on the plate.

As noted above, the movement of feeder arm 42 about the axis defined by pivot pins 134, 136 is determined by control arm 144. As best seen in FIG. 8, control arm 144 is pivotally connected to a flange 196 by a flexible support member (such as a rubber washer with a groove formed on its outer perimeter) which is coupled to the bottom of support pin 198. So connected, the left-hand end of control arm 144 (as viewed in FIG. 8) is permitted to pivot up and down as shown by arrow 200. The left end of control arm 144 is coupled to the bottom of a lifting pin 202 by a pair of lock washers 204, 206. Lifting pin 202 extends through the central axis of support member 122 and is slidably coupled thereto by a pair of low friction cylindrical sleeves 208, 210. Lifting pin 208 is movable between a lowermost position illustrated in FIG. 10, wherein it is out of contact with pin 138, and an uppermost position illustrated in FIG. 9, where lifting pin 202 is in contact with pin 208 and raises lifting arm 42 to its uppermost position corresponding to path segment 60 of FIG. 2. Lifting pin 202 is moved between these two positions as the left-hand side of control rod 104 is pivoted up and down about pin 198. The particular position of the left-hand side of control rod 144 (and therefore the positions of lifting pin 202 and pusher arm 42) is controlled by the position of rotating member 146.

As best viewed in FIG. 8, a cam follower 212 is positioned on the right-hand end of control rod 144 and is biased into contact with the cam track 214 formed on the bottom of rotating member 146 by the weight of pusher arm 42 which exerts a downward force on lifting pin 202. As rotating member 146 is rotated by motor 158, cam follower 212 follows the contour of the cam track 214 and raises and lowers the left-hand side of control rod 144, and therefore raises and lowers pusher arm 42. As best viewed in FIG. 11, cam track 14 includes four sections 216, 218, 220 and 222. Cam section 216 controls the position of pusher arm 42 as food pushing surface 44 moves along path segment 61. Cam segment 218 controls the position of pusher arm 42 during a period of time in which food pusher surface 44 traverses paths 50 and 52. It should be noted that in this position lifter pin 202 will be at its lowermost position and the bottom of pushing surface 44 will be dropped into contact with the eating surface 40 of plate 26 by the force of gravity. Cam portion 214 controls the motion of pusher arm 42 when food pushing surface 44 traverses path segments 54 and 58. Finally, cam segment 222 controls the position of pusher arm 42 when food pushing surface 44 traverses path 60. By properly forming each of the cam sections 216–222, it is possible to ensure that pusher arm 42 follows the desired path as it rotates about the axis defined by pivot pins 134, 136.

As a safety feature, it is preferred that support pin 198 be biased into the position illustrated in FIG. 8 by a compression spring 224. Spring 224 is retained on support pin 198 by a lock washer 226 and permits lifting pin 202 to be pushed down into its lower position by an external force even when lifting pin 202 is raised and is in contact with pin 138. As such, pusher arm 42 can be pushed down towards plate 26 by an external force even when it is traversing path segment 60. This is a safety feature both because it prevents damage to feeder 10 and because it can prevent injury to the user of the feeder.

SPOON SUPPORT AND LIFTING SECTION

Figure 4:
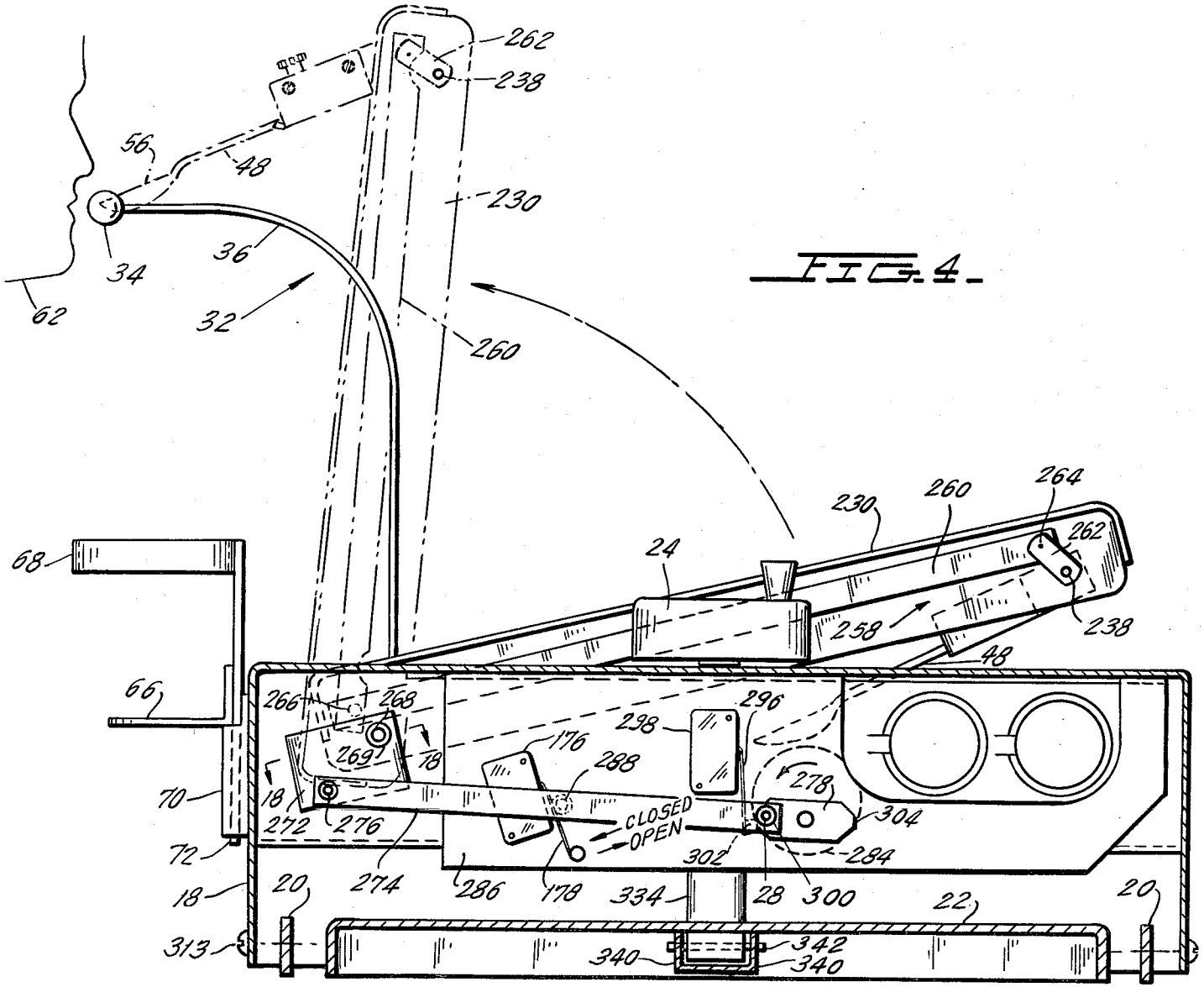
FIG. 4 is a cross-sectional view of the spoon support and lifting section of the present invention taken along lines 4—4 of FIG. 2.

As noted above, spoon support and lifting section 16 raises and lowers spoon 48 between its lower and upper positions illustrated in FIG. 4. When in its lower position, spoon 48 must form a predetermined angle with the eating surface 40 of plate 26 to ensure that food located on the plate will be pushed onto the bowl 56 of spoon 48 as arm 42 traverses path segment 54. See FIG. 2.

In order to ensure the foregoing orientation, spoon 48 is secured in place by spoon clamp 228 which is connected to spoon lifting arm 230 by a torsion spring 232. As best seen in FIG. 3, one end of spring 232 is coupled to a bracket 234 (which is also coupled to the rear of clamp 228) and is coupled at the other end to a cylindrical stop 236. Stop 236 is affixed to the distal end of a spoon support shaft 238 by a set screw 240 for rotation therewith. As will be explained in greater detail below, shaft 238 pivots with respect to arm 230 as arm 230 is moved between its lower and upper positions but is retained at substantially the same angular orientation with respect to housing 18. As a result, spoon clamp 228, and therefore spoon 48, is also maintained at a predetermined angular orientation with respect to housing 18.

Figure 7:
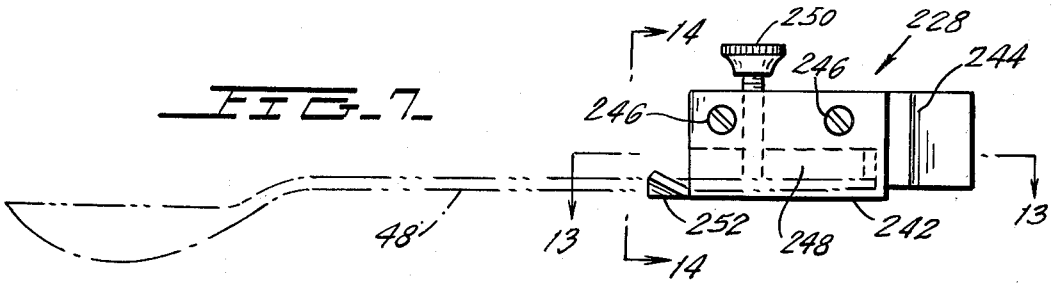
FIG. 7 is a detailed side view of the spoon holder of the present invention.
Figure 13:
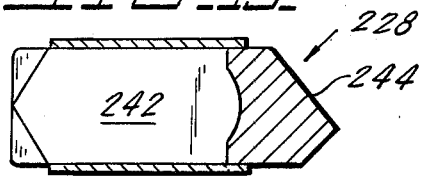
FIG. 13 is a cross-sectional view of the spoon holder of the present invention taken along lines 13—13 of FIG. 7.
Figure 14:
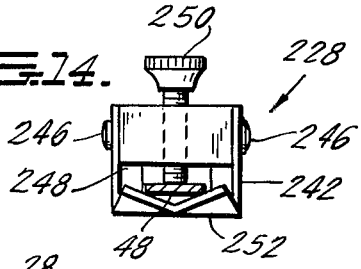
FIG. 14 is a front view of the spoon holder of the present invention taken along lines 14—14 of FIG. 7.

The structure of spoon clamp 228 may best be understood with reference to FIGS. 7, 13 and 14. As shown therein, spoon clamp 228 includes a U-shaped member 242 which is coupled to a hub member 244 by a plurality of screws 246. U-shaped member 242 and hub member 244 cooperate to define a spoon receiving recess 248 into which the end of spoon 48 may be placed. It should be noted that the end of spoon 48 must be pushed all the way into recess 248 until it centers itself in the concave face of hub member 244.

Figures 6, 12, 15, 17, 18:
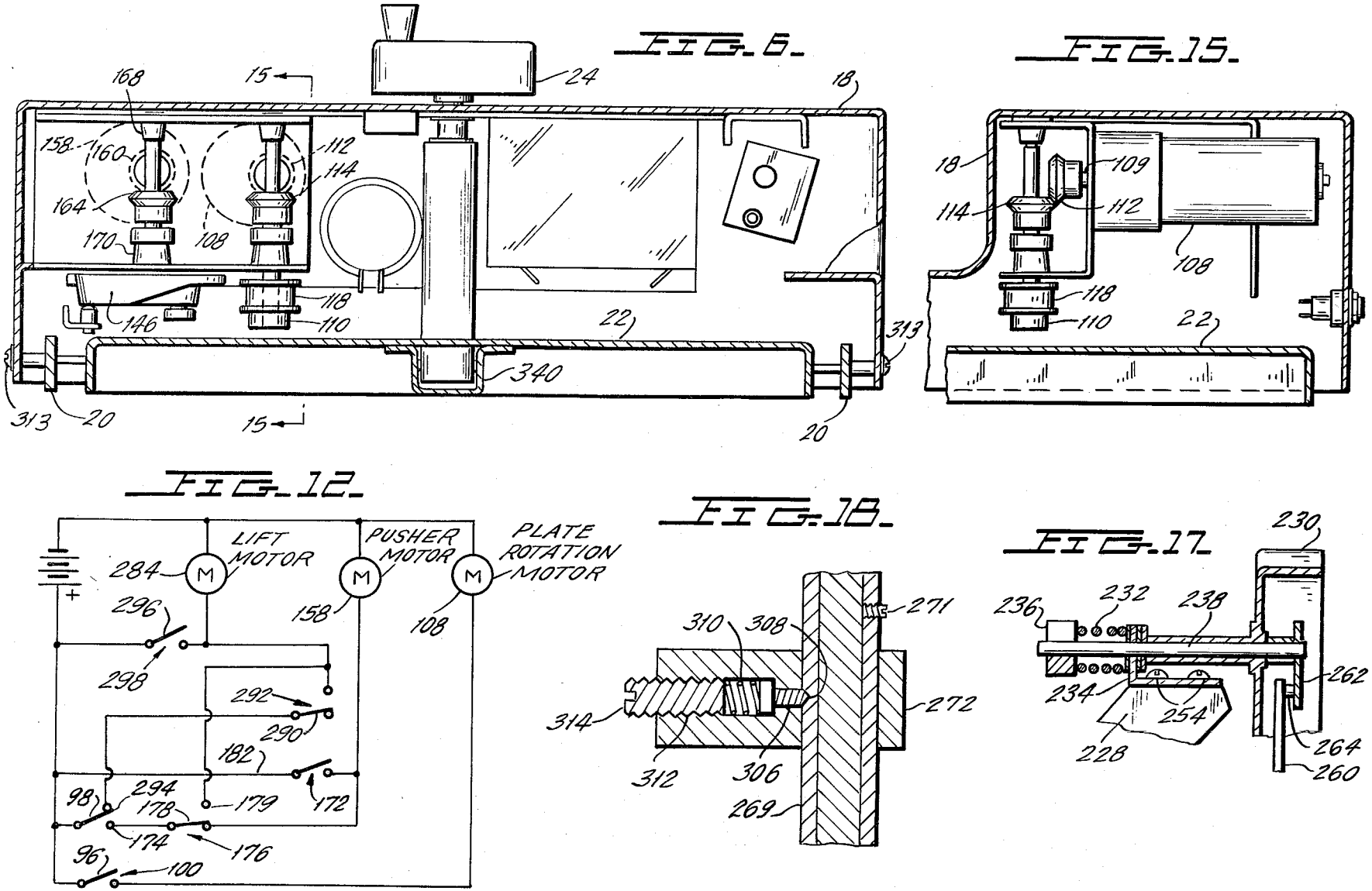
FIG. 6 is a cross-sectional view, partially broken away, of the self-feeder of the present invention taken along lines 6—6 of FIG. 3.
FIG. 12 is a schematic diagram of the control circuit of the present invention.
FIG. 15 is a cross-sectional view of a portion of the plate rotating section of the present invention taken along lines 15—15 of FIG. 6.
FIG. 17 is a detailed view, partially in cross-section, of a portion of the spoon support and lifting section of the present invention.
FIG. 18 is a detailed cross-sectional view of a release mechanism forming a portion of the spoon support and lifting section of the present invention and taken along lines 18—18 of FIG. 8.

Spoon 48 is held in recess 248 by a set screw 250 which may be raised and lowered with respect to the bottom of U-shaped member 242 by rotating the same. The front end 252 of U-shaped member 242 is bent into a V-shape to ensure proper orientation of spoon 48 when set screw 250 is placed into pressure contact therewith. See FIG. 14. This is an important feature of the invention since the orientation of spoon 48 is determined by the orientation of spoon clamp 228. As best shown in FIG. 17, the rear end of clamp 228 is connected to an L-shaped coupling member 234 by a pair of screws 254. Coupling member 234 is, in turn, coupled to spoon support shaft 238 by torsion spring 232 and cylindrical stop 236 in the manner described above. The spring constant of torsion spring 232 is chosen to ensure that clamp 228, and therefore spoon 48, is retained at a predetermined angular orientation about shaft 238 during normal operation (i.e., when only the force of gravity is applied to spoon 48) but is permitted to rotate about shaft 238 whenever a force greater than a predetermined minimum force is applied to spoon 42. This is an important safety feature since spoon 48 can easily contact the face of the individual 62 utilizing the feeder 10 when the spoon 48 is moved into its upper position illustrated in FIG. 4.

As shown in FIG. 4, the orientation of spoon 48 with respect to the horizontal is preferably maintained at a constant angle as spoon 48 is raised from its lower to its upper position. This is desirable since it ensures that food placed in the bowl 56 of spoon 48 will not fall off the spoon as it is raised to its upper position. In order to attain this result, spoon lifting arm 230 is provided with a crank mechanism 258 which causes shaft 238, and therefore spoon 48, to remain at a predetermined angular orientation with respect to the planar surface 28 as spoon lifting arm 230 is moved back and forth between its upper and lower positions. Crank mechanism 258 includes an elongated crank arm 260 and a crank 262 which is coupled to the base end of shaft 238 for rotation therewith. Crank arm 260 is rotatably coupled at one end to crank 262 by a crank pin 264 and is rotatably coupled at the other end to housing 18 by pivot pin 266. See FIGS. 3 and 4.

Spoon lifting arm 230 is coupled at its base end to a cylindrical shaft 268 which extends through the outer wall of housing 18 and is coupled to crank 272, via a cylindrical sleeve 269, for rotation therewith. In a manner which will be described below, crank 272 is reciprocated back and forth by control rod 274 causing arm 230 to move between its lower and upper positions as viewed in FIG. 4. Since crank arm 260 is coupled to housing 18 by pivot pin 266, crank 262 will rotate with respect to spoon lifting arm 230 as arm 230 is raised and lowered between its upper and lower positions. By properly selecting the length of crank 262, it is possible to maintain the angle of spoon 48 with respect to planar surface 28 constant. If it is desirable to decrease the angle of spoon 48 with respect to planar surface 28 as arm 230 is raised, the length of crank 262 should be decreased slightly.

As seen in FIGS. 3 and 4, shaft 268 is coupled to sleeve 269 by a set screw 271 and rotates therewith. Sleeve 269 is rotatably supported in housing 18 by a pair of bearings 270 and is releasably coupled to crank 272 by a coupling arrangement described below with reference to FIG. 18. It is sufficient at this time to recognize that crank 272 normally rotates with shaft 268. Crank 272 is pivotally connected to one end of control rod 274 by crank pin 276. The opposite end of control rod 276 is coupled to a rotating cam member 278 by a pivot pin 280. Cam member 278 is coupled at its central axis to the output shaft 282 of lift motor 284. Whenever motor 284 is energized, rotating cam member 278 will rotate 180° causing an approximately 75° rotation of crank 272. When sppon 48 is in its lower position, lift arm 230, crank 272, control rod 274 and cam member 278 are in the positions shown in FIG. 4. A 180° rotation of cam 278 will cause crank 272 to pivot counterclockwise about cylindrical shaft 268, causing arm 230 to raise into its upper position illustrated in phantom in FIG. 4. When spoon lifting arm 230 is in its upper position, cam member 278 will have rotated 180° from the position illustrated in FIG. 4 and pivot pin 280 will be at its rightmost point as viewed in FIG. 4. When motor 284 is again energized, cam 278 will rotate an additional 180°, causing crank 272 to return to the position illustrated in FIG. 4, thereby causing spoon lifting arm 230 to return to its lower position.

The manner in which lift motor 284 is energized will now be described with reference to FIGS. 4 and 12. As shown in FIGS. 3 and 4, switch 176 is coupled to an inner wall 286 of casing 18 and is so situated that its switch arm 178 is closed by a projection 288, depending from control rod 274, when spoon lifting arm 230 is in its lower position. When switch arm 178 of switch 176 is closed, it is in the position illustrated in FIG. 12.

To initiate a spoon lifting operation, chin switch 32 is rotated clockwise as viewed in FIG. 3, causing switch arm 98 of switch 102 to contact terminal contact 174, thereby applying power to pusher motor 158. Pusher motor 158 causes rotating member 146 to begin rotating in a counterclockwise direction as viewed in FIG. 11. After pusher arm 42 begins its return stroke from its second position B back to its first position A, cam 174 comes into contact with contact arm 290 of switch 292, causing switch 292 to close. If chin switch 32 has been released, switch arm 98 of switch 102 will have returned to its rest position in contact with terminal contact 294. In this condition, power is applied to lift motor 284. The application of power to lift motor 284 causes cam 278 to begin rotating thereby permitting the switch arm 296 (see FIG. 4) of switch 298 to move to the right as viewed in FIG. 4. This action closes switch 298 causing power to be directly applied to lift motor 284. See FIG. 12. Power will continue to be applied to lift motor 284 until cam 278 has rotated 180° and cam surface 304 comes into contact with the cam follower portion 302 of switch arm 296. At this point, switch 298 opens and, assuming that chin switch 32 is in its rest or off position, motor 284 is deenergized. Spoon 48 will now be in the upper position illustrated in FIG. 4 and the individual 62 will be free to remove food from the bowl 56 of the spoon 48. After the individual 62 has removed food from the spoon 48, he can return spoon lifting arm 230, and with it spoon 48, to its lower position by rotating chin switch 32 clockwise thereby causing the switch arm 98 of switch 102 to contact terminal contact 174. Since arm 230 is in its upper position, projection 288 will be out of contact with switch arm 178 and switch arm 178 will be in contact with terminal contact 179. As such, when switch arm 98 is placed in contact with terminal contact 174, power is applied to lift motor 284 via switch arms 98 and 178. Cam 278 will again begin rotating, releasing cam follower portion 302 and directly energizing lift motor 284 until cam portion 304 is again in contact with cam follower portion 302. At this time, spoon lifting arm 230 will have been returned to its lower position and a new food pushing operation may be initiated.

In the foregoing description, it has been assumed that chin switch 32 is released shortly after the initiation of a food pushing operation. If the operator 62 sees that food pushing arm 42 has not placed a sufficient amount of food on spoon 48, he can abort a spoon lifting operation by retaining switch arm 32 in its clockwise position as viewed in FIG. 3 during the return path of food pusher arm 42 from its position B adjacent the spoon 48 to its position A adjacent the rim of plate 26. When chin switch 32 is in this position, arm 98 of switch 102 is in contact with terminal contact 174 and power will not be applied to lift motor 284 when switch 292 is closed by cam 174. Instead, power will continue to be applied to pusher motor 158 until pusher arm 42 returns to its first position A at which time a food pushing operation may be reinstituted by again rotating chin switch 32 into its clockwise position.

As a safety feature, crank 272 is releasably coupled to support cylinder 269, and therefore shaft 268, in order that crank 272 can rotate independently of shaft 269 whenever a force greater than a predetermined value is applied to spoon lifting arm 230. As shown in FIG. 1B, the coupling mechanism includes a contact pin 306 which is releasably biased into a cone shaped recess 308 formed in the outer periphery of support cylinder 269 by a compression spring 310. The compression spring 310 and the contact pin 306 are situated in a cylindrical opening 312 formed in crank 272. A portion of opening 312 is internally threaded and receives an externally threaded set screw 314 which retains spring 310 and crank pin 306 in place. The force applied by spring 310 on contact pin 306 may be adjusted by rotating set screw 314 either further into or further out of opening 312. In this manner, the external force which must be applied to spoon lifting arm 230 to disengage crank 272 from support cylinder 269, may be adjusted. When the external force applied to spoon lifting arm 230 is greater than this value, crank 272 will be free to rotate to either of its two extreme positions corresponding to the upper and lower positions of spoon lifting arm 230, respectively, independently of shaft 268. When lift motor 284 is again energized and crank 272 is reciprocated in the opposite direction, recess 308 will again align with the tip of contact pin 306, permitting contact pin 306 to enter the recess and thereby recoupling crank 272 and support cylinder 269.

The importance of the foregoing feature of the present invention may best be understood by way of example. After food has been placed on spoon 48 by pusher arm 42, motor 284 is energized and crank 272 is rotated counterclockwise as viewed in FIG. 4, causing spoon lifting arm 230 to pivot towards its upper position. If the operator's face is placed too far to the right as viewed in FIG. 4, spoon 48 will contact his face before spoon lifting arm 230 has reached its uppermost position. If crank 272 were fixedly coupled to shaft 268, arm 230 would continue to rise and could injure the operator of feeder 10. As a result of the foregoing coupling arrangement, the resistant force supplied by the face of operator 62 will counteract the force of spring 310 and cause pin 306 to withdraw from recess 38. In this condition, crank 272 will be free to continue to rotate while spoon lifting arm 230 remains at a position somewhat below its uppermost position. Arm 230 will not return to its lower position since pin 306 is still in friction contact with the outer surface of sleeve 269. When the operator 62 again rotates chain switch 32 counterclockwise, crank 272 also rotates clockwise causing recess 308 to move in the direction of contact pin 306. When contact pin 306 is aligned with recess 308, it will be forced into the recess by the force of spring 310, thereby recoupling sleeve 269 to crank 272. At this point, spoon lifting arm 230 will be returned to its lower position by the clockwise rotation of crank 272.

LIFTING MECHANISM

As shown in FIGS. 1 and 2, housing 18 is supported by a pair of legs 20, 22. Leg 20 is a U-shaped member which is coupled to opposite sides of housing 18 by respective pivot pins 313 (see FIG. 6) and is pivotally coupled to opposite sides of leg 22 by respective fasteners 322, 324. See FIGS. 1 and 2. Support leg 22 is a plate-shaped member which is slidably coupled on opposite sides to a pair of support members 320 (only one of which is illustrated in FIG. 2) which depend from planar surface 28 on either side of housing 18. As best seen in FIG. 2, leg 22 is slidably coupled within an elongated slot 322 in each support member 320 by a screw 324 and a nut 326. So connected, legs 20, 22 are adjustable from a fully withdrawn position illustrated in solid lines in FIG. 2 to a fully extended position illustrated in phantom. As seen in FIGS. 1 and 2, a pair of high friction support pads 316, 318 are coupled to the bottom of leg 20 while a pair of high friction support pads 328, 330 are coupled to the bottom of leg 22. Support pads 316, 318, 328 and 330 preferably extend below the bottom edge of legs 20, 22 in order that the pads, and not the legs 20, 22, are in contact with the support surface (not shown) on which feeder 10 is placed.

The position of legs 20, 22 with respect to housing 18 is controlled by a crank mechanism including rotary crank 24 and a double screw coupling member 325. Coupling member 326 includes an externally threaded screw member 327, a floating sleeve 336 and an internally threaded hollow cylindrical member 334. Coupling member 325 is rotatably coupled at one end to housing 18 by bearing member 332 and is pivotally coupled at the other end to a U-shaped support member 340 by pivot pin 342. See FIGS. 2 and 4. Cylindrical member 334 extends through an opening 338 formed in leg 22 for connection to support member 340. Opening 338 is of sufficient size to permit cylindrical member 334 to pivot with respect to leg 22 as legs 20, 22 are moved between their fully retracted and fully extended positions.

The top portion 326 of screw member 328 is coupled to crank member 24 by a set screw 330 for rotation therewith. Sleeve 336 includes an internally threaded portion 348 which engages the external threads of screw member 328. Internal threads formed on cylindrical member 334 similarly engage external threads formed about the periphery of sleeve 336.

When crank 24 is rotated in a clockwise direction as viewed in FIG. 1, screw member 328 rotates therewith. Depending upon the particular friction engagement between the threads of screw member 328 and sleeve 336 on the one hand and between sleeve 336 and cylindrical member 334 on the other hand, either sleeve 336 or both sleeve 336 and cylindrical member 334 will move downwardly along screw member 328. When floating sleeve 336 moves all the way down the shaft of screw member 327, it will contact stop pin 346 which prevents further downward movement of sleeve 336. At this point, cylindrical member 334 will continue moving down sleeve 336 until it is also fully extended. If crank 24 is rotated in the counterclockwise direction as viewed in FIG. 1, cylindrical member 334 and/or threaded sleeve 336 will move upward with respect to the shaft of screw member 328, thereby withdrawing legs 20, 22 back towards housing 18.

The present invention may be embodied in other specific forms without departing from the spirit or essential attributes thereof and, accordingly, reference should be made to the appended claims, rather than to the foregoing specification as indicating the scope of the invention.

What is claimed is:

1. A self-feeding device for automatically lifting food off the eating surface of a plate to an eating position located above said plate, said device comprising:

(A) means for supporting a plate having an eating surface;

(B) pusher means including a food pushing surface, said pusher means being capable of moving said food pushing surface along a predetermined path which traverses a portion of said eating surface of said plate in such a manner that food located on said eating surface of said plate along said predetermined path is moved by said pushing surface, said path being generally arcuate as viewed in a first plane parallel to said eating surface and generally polygonal as viewed in a second plane orthogonal to said first plane;

(C) spoon support means capable of moving a spoon between a lower position in which food moved by said pushing surface is moved onto said spoon and an upper position in which food moved on said spoon by said pushing surface is located at said eating position; and (D) human actuable control means operable in a first mode wherein said control means causes said pusher means to move said pusher surface along said predetermined path such that food located on eating surface is moved on to said spoon and causes said spoon support means to move said spoon from said lower to said upper position after said food is moved on to said spoon responsive to the selective actuation of said control means by an operator of said self-feeding device.

2. The self-feeding device of claim 1, wherein said plate support means is capable of rotating said plate about a predetermined axis.

3. The self-feeding device of claim 2, wherein said control means is also operable in a second mode wherein said control means causes said plate support means to rotate said plate about said axis by an angle determined by the operator of said self-feeding device whereby said operator may determine which portion of said plate is traversed by said food pushing surface as said food pushing surface moves along said predetermined path.

4. The self-feeding device of claim 3, wherein said support means comprises a plurality of vertical shaft rollers.

5. The self-feeding device of claim 4, wherein said plate contacts only said rollers.

6. The self-feeding device of claim 3, wherein said control means is also operable in a third mode wherein said control means causes said spoon support means to lower said spoon to said lower position when said spoon is in said upper position.

7. The self-feeding device of claim 3, wherein said control means includes a human actuable switch movable into first and second positions and wherein:

(A) said control means causes said pusher means to move said food pushing surface from a first position near the edge of said plate to a second position beyond said spoon and thereafter causes said spoon support means to move said spoon from said lower to said upper position responsive to movement of said switch into said first position when said spoon is in said lower position; and (B) said control means causes said plate support means to rotate said plate about said axis whenever said switch is placed in said second position.

8. The self-feeding device of claim 7, wherein the angle through which said plate is rotated by said plate support means is determined by the length of time said switch is in said second position.

9. The self-feeding device of claim 6, wherein said control means further includes means for preventing said spoon support means from moving said spoon from said lower to said upper position after said pusher means moves said food pushing surface from said first to said second position.

10. The self-feeding device is claim 9, wherein said preventing means is actuated by placing said switch in said first position after said pusher means pushes food onto said spoon.

11. The self-feeding device of claim 7, wherein said control means also causes said pusher means to automatically return said food pushing surface from said second position back to said first position after said food pushing surface has been moved to said second position.

12. The self-feeding device of claim 11, wherein said pusher means moves said food pushing surface from said second to said first position along a path which is at all times above said eating surface of said plate.

13. The self-feeding device of claim 12, wherein said pusher means includes a pusher arm which is pivotable about a first axis, said food pushing surface depending from said pusher arm.

14. The self-feeding device of claim 13, wherein said pusher arm is also pivotable about a second axis orthogonal to said first axis.

15. The self-feeding device of claim 14, wherein said pusher means includes means for pivoting said pusher arm about said first and second axis as said food pushing surface is moved from said first to said second and back to said first positions.

16. The self-feeding device of claims 1, 12 or 15, wherein said food pushing surface rests on said food eating surface during a substantial portion of its movement from said first to said second positions.

17. The self-feeding device of claim 7, wherein said control means is also operable in a third mode wherein said control means causes said spoon support means to lower said spoon to said lower position when said switch is placed in said first position and said spoon is in said upper position.

18. The self-feeding device of claim 1, wherein said spoon support means includes a spoon lifting arm rotatable about a predetermined axis and wherein said spoon is resiliently coupled to said spoon lifting arm.

19. The self-feeding device of claim 1, further including means for disabling said spoon support means when a force greater than a predetermined value and resistant to movement of said spoon from said lower to said upper position is applied to said spoon.

20. The self-feeding device of claim 1, further including means for disabling said pusher means when a force greater than a predetermined value and resistant to movement of said food pushing surface along said predetermined path is applied to said food pushing surface.

21. The self-feeding device of claim 1, wherein said predetermined path begins at an initial position near and above the edge of said plate, continues along the eating surface of said plate to an area adjacent said spoon in its lower position, continues to a location above both said spoon and said plate and then returns back to said initial position.

* * * * *